US008851650B2

(12) United States Patent
Takemoto

(10) Patent No.: US 8,851,650 B2
(45) Date of Patent: Oct. 7, 2014

(54) METHOD OF PRODUCING TRANSFER MEDIUM, SET OF INK AND ADHESIVE LIQUID USED FOR THE METHOD, TRANSFER MEDIUM, AND APPARATUS FOR PRODUCING THE TRANSFER MEDIUM

(75) Inventor: Kiyohiko Takemoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 13/224,584

(22) Filed: Sep. 2, 2011

(65) Prior Publication Data

US 2012/0058285 A1 Mar. 8, 2012

(30) Foreign Application Priority Data

Sep. 2, 2010 (JP) ..... 2010-196748
Sep. 2, 2010 (JP) ..... 2010-196753

(51) Int. Cl.
*B41J 2/01* (2006.01)

(52) U.S. Cl.
USPC ..... 347/100

(58) Field of Classification Search
USPC ..... 347/100
See application file for complete search history.

(56) References Cited

U.S. PATENT DOCUMENTS

| | | | | |
|---|---|---|---|---|
| 7,419,257 | B2 | 9/2008 | Mouri et al. | |
| 2003/0231234 | A1 * | 12/2003 | Ushirogouchi et al. | 347/100 |
| 2007/0052785 | A1 * | 3/2007 | Itoh et al. | 347/101 |

FOREIGN PATENT DOCUMENTS

| | | | |
|---|---|---|---|
| JP | 56-28256 | A | 3/1981 |
| JP | 356573 | A | 3/1991 |
| JP | 3-79678 | A | 4/1991 |
| JP | 03160068 | A | 7/1991 |
| JP | 4-18462 | A | 1/1992 |
| JP | 07-314879 | A | 12/1995 |
| JP | 2000-141992 | A | 5/2000 |
| JP | 2003-001924 | A | 1/2003 |
| JP | 2003-231397 | A | 8/2003 |
| JP | 2005-343049 | A | 12/2005 |
| JP | 2009-255322 | A | 11/2009 |

* cited by examiner

*Primary Examiner* — Laura Martin
(74) *Attorney, Agent, or Firm* — Nutter McClennen & Fish LLP

(57) ABSTRACT

Provided is a method of producing a transfer medium including attaching ink which contains a resin and is discharged from an ink jet head onto a substrate; evaporating at least a part of the liquid component included in the ink having been attached to the substrate; and attaching adhesive liquid which contains a resin and is discharged from the ink jet head to a substrate surface where the ink in which at least a part of the liquid component has been evaporated is attached.

7 Claims, 4 Drawing Sheets

METHOD OF PRODUCING TRANSFER MEDIUM, SET OF INK AND ADHESIVE LIQUID USED FOR THE METHOD, TRANSFER MEDIUM, AND APPARATUS FOR PRODUCING THE TRANSFER MEDIUM

The entire disclosure of Japanese Application No.: 2010-196748 filed on Sep. 2, 2010 and 2010-196753 filed on Sep. 2, 2010 are expressly incorporated by reference herein.

BACKGROUND

1. Technical Field

The present invention relates to a method of producing a transfer medium, a set of ink and adhesive liquid used for the method, a transfer medium, and an apparatus for producing the transfer medium.

2. Related Art

There is known a transfer medium transferring letters or image patterns formed by attaching ink onto a substrate to a target. Regarding the transfer medium, there is known a technique in which adhesive liquid is coated on a pattern according to the shape of the pattern by using, for example, a screen printing plate, as described in JP-A-7-314879.

However, when letters, image patterns, or adhesive liquid patterns are formed using a printing plate of screen printing, flexo printing, gravure printing, or the like, production costs increase in small quantity batch production. Therefore, in order to suppress the production costs to be low in small quantity batch production, a method in which the letters or patterns are formed by discharge of ink from an ink jet head has been suggested.

However, when the letters, the image patterns, and the adhesive liquid patterns are formed using a printing plate of flexo printing, gravure printing, or the like as well as the screen printing plate, production costs increase for small quantity batch production of the transfer medium. Therefore, in order to suppress the production costs to be low in small quantity batch production of the transfer medium, a method of producing a transfer medium is considered in which ink and adhesive liquid are discharged from an ink jet head so as to be attached to a substrate, whereby a colored layer created by the ink and an adhesive layer created by the adhesive liquid are formed on the substrate in sequence.

Herein, the following properties are required for the ink discharged from the ink jet head to form the colored layer and for the adhesive liquid discharged from the ink jet head for forming the adhesive layer.

First, it is required for the ink and the adhesive liquid to have excellent discharge stability when the ink jet head is driven at a high frequency.

Second, in a process of forming the pattern of the adhesive layer by attaching the adhesive liquid on the pattern of the colored layer, it is required that letters or images of a high resolution are obtained without a case where the colored layer pattern runs or becomes messed up.

Third, it is required that a thermoplastic resin configuring the adhesive layer is efficiently distributed on the colored layer pattern, and that the resultant exhibits an excellent transfer property when being used as the transfer medium, without causing defective transfer of fine letters and transfer unevenness of images.

Fourth, it is required that excellent adhesiveness is exhibited after transfer between a medium to be transferred or the colored layer and the adhesive layer.

SUMMARY

An advantage of some aspects of the invention is to provide a method of producing a transfer medium, which achieves excellent discharge stability when ink for forming a colored layer and adhesive liquid for forming an adhesive layer are discharged from an ink jet head, can obtain a pattern of the colored layer with a high resolution, and exhibits an excellent transfer property or adhesiveness after transfer, a set of the ink and the adhesive liquid used for the method, a transfer medium obtained by the producing method, and an apparatus for producing the transfer medium.

The present inventors performed thorough research to solve the above problems. As a result, they found that the problems can be solved by discharging and attaching the adhesive liquid after evaporating at least a part of the liquid component of the ink having been discharged and attached to a substrate, whereby the inventors completed the invention.

That is, the present invention is as follows.

[1] A method of producing a transfer medium including: attaching ink which contains a resin and is discharged from an ink jet head onto a substrate; evaporating at least a part of the liquid component included in the ink having been attached to the substrate; and attaching adhesive liquid which contains a resin and is discharged from the ink jet head to a substrate surface where the ink in which at least a part of the liquid component has been evaporated is attached, wherein the content ratio of the resin in the ink is smaller than that of the resin in the adhesive liquid.

[2] A method of producing a transfer medium including: attaching ink which is discharged from an ink jet head onto a substrate; evaporating 65% to 95% by mass of the component excluding a solid content of the ink having been attached to the substrate; and attaching adhesive liquid discharged from the ink jet head to a substrate surface where the ink in which 65% to 95% by mass of the component excluding a solid content has been evaporated is attached.

[3] The method of producing a transfer medium according to [1] or [2], wherein the ink is an aqueous pigment ink, the aqueous pigment ink includes a water-soluble organic solvent having a boiling point of 70° C. to 250° C., and the water-soluble organic solvent is an aqueous liquid including one or more kinds selected from lactams, carboxylic acid esters, alkylene glycol ethers, and alcohols.

[4] The method of producing a transfer medium according to [1] or [2], wherein the adhesive liquid includes a water-soluble organic solvent having a boiling point of 70° C. to 250° C., and the water-soluble organic solvent is aqueous liquid including one or more kinds selected from lactams, carboxylic acid esters, alkylene glycol ethers, and alcohols.

[5] The method of producing a transfer medium according to [1] or [2], wherein the adhesive liquid is an aqueous liquid including an emulsion type thermoplastic resin.

[6] The method of producing a transfer medium according to [1] or [2], wherein the substrate is a metal, plastic, or paper.

[7] A transfer medium obtained by the producing method according to [1] or [2].

[8] A set of ink and adhesive liquid used for the method of producing a transfer medium according to [1] or [2].

[9] An apparatus for producing a transfer medium including: an ink attaching unit in which ink is discharged from an ink jet head and attached onto a substrate; an evaporation unit in which 65% to 95% by mass of the component excluding a solid content in the ink having been attached to the substrate is evaporated; and an adhesive liquid attaching unit in which adhesive liquid is discharged from the ink jet head and attached to a substrate surface where the ink in which 65% to 95% by mass of the component excluding a solid content has been evaporated is attached.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
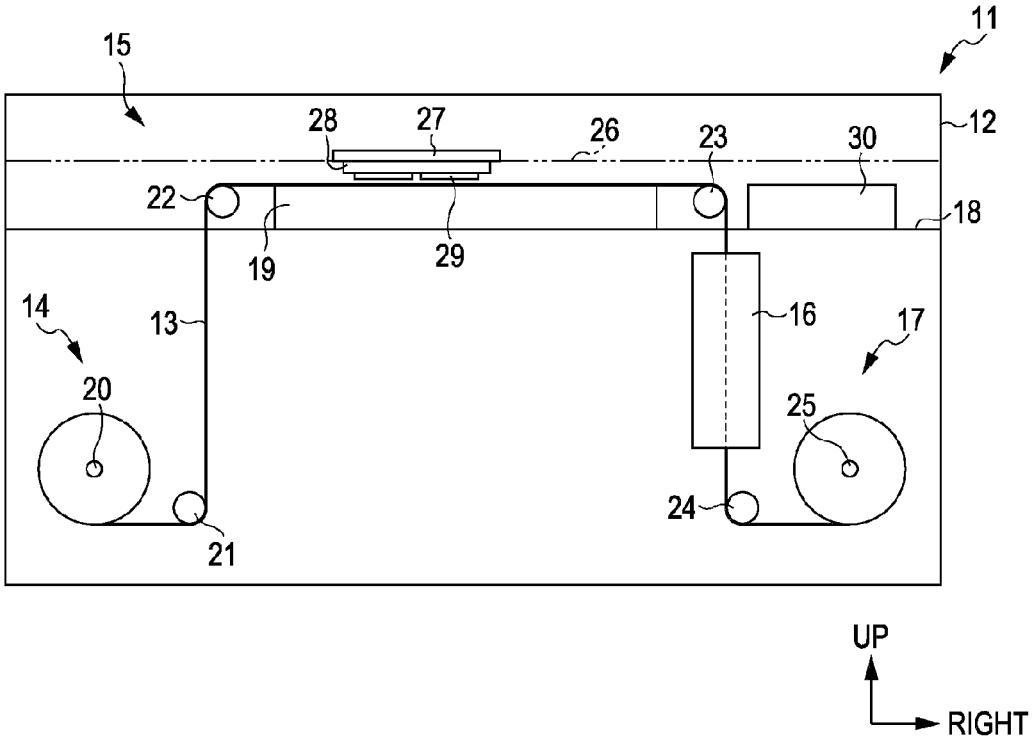
FIG. 1 is a schematic front view of an example of a transfer medium producing apparatus according to the present embodiment.

Hereinafter, the embodiments of the invention will be described in detail. The invention is not limited to the following embodiments, and various modifications can be made within the range of the scope of the invention.

In the present specification, "discharge stability" refers to a property of always stably discharging ink droplets from nozzles without nozzle clogging. A "transfer property" refers to a property of requiring a small amount of energy when a colored layer is transferred from a transfer medium to a medium to be transferred. The energy depends on one or more of temperature, pressure, and time in transferring, and if at least any one of low temperature, low pressure, and short time is achieved in transferring, it can be said that the transfer property is excellent. "Adhesiveness" refers to a property of excellent adhesive strength of the colored layer transferred to the medium to be transferred.

In the specification, "(meth)acryl" refers to "acryl" and "methacryl" corresponding thereto, and "(meth)acrylate" refers to "acrylate" and "methacrylate" corresponding thereto.

In the specification, a "solid content" refers to a substance which is in a solid state under conditions of 1 atm and 25° C.

In the specification, a "medium boiling point" refers to a boiling point of 70° C. to 250° C. at 1 atm.

In the specification, the "substrate" refers to a supporter used for transferring the pattern of the colored layer and the adhesive layer. The "transfer medium" refers to a medium including at least the substrate, colored layer, and adhesive layer and is transferred to the medium to be transferred. The "medium to be transferred" refers to a medium to which at least the colored layer and the adhesive layer are transferred from the transfer medium.

In the specification, "transfer" has a meaning including sticking.

Method of Producing Transfer Medium

An embodiment of the invention relates to a method of producing a transfer medium. The producing method includes attaching ink which contains a resin and is discharged from an ink jet head onto a substrate; evaporating at least a part of the liquid component included in the ink having been attached to the substrate; and attaching adhesive liquid which contains a resin and is discharged from the ink jet head to a surface where the ink in which at least a part of the liquid component has been evaporated is attached, wherein the content ratio of the resin in the ink is smaller than that of the resin in the adhesive liquid.

Attaching Ink

In attaching ink in the embodiment, ink containing a resin is discharged from an ink jet head and attached to a predetermined portion on a substrate. In this manner, the pattern of the colored layer is formed on the substrate. An ink jet recording apparatus can be used as an apparatus for attaching ink, and examples of the ink jet recording apparatus include PX-7550 (an ink jet printer, manufactured by Seiko Epson Corporation), but the apparatus is not limited thereto. During ink discharge in attaching ink, the droplet mass may be adjusted within a range of 5 ng to 15 ng, for example.

Ink

The ink described above is used for forming the colored layer, and it is preferable that the ink include a thermoplastic resin to improve the ease of transfer and adhesiveness with respect to the medium to be transferred or to the colored layer during transfer.

As the ink, an aqueous ink is preferable since this ink is excellent in terms of discharge stability.

Examples of colorants included in the ink include pigments and dyes, and among these, pigments are preferable since they can improve light resistance of an ink composition.

From the viewpoints described above, aqueous pigment ink is more preferable as the ink used in the embodiment. Based on its excellent discharge stability, an aqueous pigment ink can form the pattern of the colored layer in the transfer medium with a high resolution. In addition, in order to make the aqueous pigment ink have an excellent transfer property, it is preferable that the ink include at least the following (1) to (5) as the constituent components.

(1) Pigment (2) Emulsion type thermoplastic resin (hereinafter, also referred to as a "resin emulsion") or a water-soluble thermoplastic resin (hereinafter, also referred to as a "water-soluble resin"), as a pigment dispersant (3) Water-soluble organic solvent having a boiling point of 70° C. to 250° C. at 1 atm.

(4) Surfactant (5) Water

Each of the above components will be described later in detail.

The content of each of the above components (1) to (5) based on the total ink amount (100% by mass) will be described. The content of (1) pigment is preferably 0.2% to 10% by mass. The content of (2) pigment dispersant is preferably 1.5% to 15% by mass. The content of (3) water-soluble organic solvent having a boiling point of 70° C. to 250° C. at 1 atm is preferably 5% to 40% by mass. The content of the (4) surfactant is preferably 0.5% to 2% by mass. The content of (5) water is preferably 50% to 92% by mass. If the content of each component is in this range, the discharge stability becomes excellent.

Substrate

Examples of the substrate include, but are not particularly limited to, a metal, wood, plastic, and paper. Metal, plastic, and paper are preferable since the substrate made of these can be easily processed into a desired shape, and plastic is more preferable in view of cost. Preferable examples of the metal include aluminum in view of cost. Preferable examples of the plastic include a polyolefin resin, a polyester resin, a polyamide resin, and a polycarbonate resin. Preferable examples of the paper include normal paper, premium quality paper, and coated paper. It is preferable that the substrate have a shape of a film or a sheet to facilitate the use of the transfer medium. The thickness of the substrate is preferably 10 μm to 50 μm.

In the substrate, at least one of a side where the colored layer is supposed to be formed and the opposite side thereof may be coated with a releasing agent, and the substrate may include a releasing layer formed of the coated layer. If the substrate includes the releasing layer at the side where the colored layer is supposed to be formed, the transfer from the transfer medium to the medium to be transferred is more easily performed. In this respect, it is preferable that the releasing layer be provided at least at the substrate side where the colored layer is supposed to be formed. If the substrate includes a releasing layer at the side opposite to the side where the colored layer is supposed to be formed, it is possible to inhibit a case where it is not easy to separate transfer media from each other since the transfer media adhere to each other when they piled on each other. Examples of the releasing agent include a polyethylene wax-based releasing agent, a silicone-based releasing agent, and a fluorine-based releasing agent. If the thickness of the releasing agent is less than 10 nm, a sufficient transfer property cannot be obtained. On the other hand, a thickness exceeding 30 nm is not preferable in view of production costs of the releasing layer, and the volume of the layer increases in this thickness if a roll-like substrate is used. Accordingly, the thickness is preferably 10 nm to 30 nm.

The producing method in the embodiment may include, prior to the attaching ink described above, forming a protective layer on the substrate surface (on the releasing layer if the substrate includes the releasing layer) at the side of the substrate where the colored layer is supposed to be formed. The protective layer is formed by attaching protective liquid to the substrate surface (releasing layer) and drying the liquid as necessary, for example. Forming the protective layer makes it possible to protect the surface of the colored layer after transfer by using the protective layer and to improve the durability of the colored layer transferred to the medium to be transferred (target). Examples of the protective liquid include liquid including an acrylic acid ester resin, a methacrylic acid ester resin, an acrylic acid ester-methacrylic acid ester copolymer resin, an acrylic acid ester-styrene copolymer resin, an acrylic acid ester-methacrylic acid ester-styrene copolymer resin, and a polyvinyl alcohol resin. If the thickness of the protective layer is less than 10 nm, the protective layer cannot sufficiently protect the colored layer. On the other hand, a thickness of exceeding 30 nm is not preferable in view of the production costs of the protective layer, or the volume of the layer increases in this thickness if a roll-like substrate is used. Accordingly, the thickness is preferably 10 nm to 30 nm.

Evaporating

In the evaporating in the embodiment (hereinafter, also referred to as a "first evaporation"), at least a part of the liquid component included in the ink attached to the substrate is evaporated. The liquid component can be referred to as the component in the ink excluding the solid content in other words, and 65% to 95% by mass of the liquid component can be evaporated, for example.

As a device for evaporating the component, for example, a platen heater, a warm air heater, and an infrared heater in the ink jet recording apparatus can be used; however, the device is not particularly limited. An example of an evaporation method in a case of using the platen heater includes a method in which while the substrate is heated from the back surface thereof by the platen heater, the ink attached to the substrate is exposed to warm air. In this evaporation method, heat is almost uniformly transmitted to the ink on the substrate. Consequently, it is possible to easily adjust the evaporation amount and to prevent curling when the substrate is paper or the like. Specifically, the amount of the evaporated component excluding the solid content in the ink attached to the substrate can be adjusted by controlling the heating temperature, heating time, the temperature of the warm air, the amount of air or the like of the heater in a platen portion. It is preferable that the conditions of the heater be preset by measuring the evaporation amount in advance before an experiment.

At least a part of the liquid component to be evaporated, which is described above, is preferably 65% to 95% by mass, and more preferably 70% to 90% by mass, based on the total ink amount (100% by mass). In this manner, if a certain amount of the liquid component in the ink discharged and attached to the substrate is evaporated, and then the adhesive liquid is discharged and attached in the next process, the pattern of the colored layer in the transfer medium can be formed with a high resolution, and an excellent transfer property can be obtained.

Among each component of the (1) to (5) described above, the solid content corresponds to each component of (1), (2), and (4), and the liquid component corresponds to each component of (3) and (5).

The evaporation amount of the liquid component can be calculated by measuring the mass change of the ink shown before and after the liquid component is evaporated under the same conditions as in the evaporating. Therefore, after conditions in which a desired amount of the liquid component is evaporated are determined in advance, the evaporation treatment of the evaporating may be performed under the same conditions.

Attaching Adhesive Liquid

In the attaching adhesive liquid in the embodiment, in a state where at least a part of the liquid component in the ink attached to the substrate has been evaporated, for example, in a state where 65% to 95% by mass of the liquid component has been evaporated, the adhesive liquid containing a resin is discharged from the ink jet head and attached to a predetermined portion on the surface where the ink has been attached. As a result, the pattern of the adhesive layer is formed on the substrate and the colored layer. As an apparatus for attaching the adhesive liquid, the ink jet recording apparatus exemplified in the attaching ink can be used. When the adhesive liquid is discharged in attaching the adhesive liquid, the droplet mass may be adjusted in a range of 5 ng to 15 ng, for example.

Adhesive Liquid

The adhesive liquid is used for forming the adhesive layer. It is preferable that the adhesive liquid include a thermoplastic resin to improve the ease of transfer and adhesiveness with respect to the medium to be transferred or to the colored layer during transfer. Examples of the adhesive liquid include aqueous liquid including an emulsion type thermoplastic resin. The aqueous liquid including an emulsion type thermoplastic resin is preferable since the thermoplastic resin functioning as an adhesive can be efficiently distributed to the surface layer.

It is preferable that the aqueous liquid including the emulsion type thermoplastic resin include at least the following components (6) to (8) as constituent components so as to form the pattern of the colored layer and the adhesive layer in the transfer medium with a high resolution based on the excellent discharge stability of the liquid and to obtain the excellent transfer property.

(6) Resin emulsion (7) Water-soluble organic solvent having a boiling point of 70° C. to 250° C. at 1 atm (8) Water The detailed description of other points of each of the components will be made later.

The content of each of the components based on the total adhesive liquid amount (100% by mass) will be described. The content of (6) resin emulsion is preferably 2.5% to 25% by mass. The content of (7) water-soluble organic solvent having a boiling point of 70° C. to 250° C. at 1 atm is preferably 10% to 40% by mass. The content of (8) water is preferably 45% to 87.5% by mass. If the content of each component is within this range, the discharge stability becomes excellent.

The adhesive liquid in the embodiment may be obtained by dispersing microcapsules containing an adhesive component including the thermoplastic resin in liquid. If this adhesive liquid is used, adhesiveness is improved by breaking the microcapsules through additional treatments such as a heating treatment or pressurizing treatment.

A desired transfer medium can be produced through attaching adhesive liquid.

Herein, the content ratio of the resin in the ink can be made smaller than the content ratio of the resin in the adhesive liquid. Provided that the content ratio of the resin in the ink is denoted as "[ink]", and the content ratio of the resin in the adhesive liquid is denoted as "[adhesive liquid]", the following formula can be established.

[ink]:[adhesive liquid]=1:2 to 1:10

Due to the above characteristics, the adhesiveness in the transfer medium after the transfer becomes excellent. Specifically, it is considered that since the adhesion between the colored layer and the adhesive layer is greater than the adhesion between a peeling layer and the colored layer, the excellent adhesiveness is obtained.

The "resin" herein refers to all resins included in each of the ink and the adhesive liquid. The resin is preferably the thermoplastic resin, and more preferably both the water-soluble resin and the thermoplastic resin included in the resin emulsion.

Second Evaporation

The producing method of the embodiment may further include forcibly evaporating (also referred to as the "second evaporation" in the specification) the liquid component (component excluding the solid content) included in the colored layer and the adhesive layer on the substrate. Examples of a method of forced evaporation in the second evaporation include heating, decompression, and exposing the component to dry air or warm air. An example of a device for realizing the method includes a warm air heater. In the second evaporation, it is preferable to evaporate more than 95% by mass of the component excluding the solid content in the ink attached to the substrate.

Needless to say, it is also possible to evaporate the component (liquid component) excluding the solid content included in the colored layer and the adhesive layer by means of natural drying after attaching the adhesive liquid, without performing the second evaporation.

Apparatus for Producing Transfer Medium

An embodiment of the invention relates to an apparatus for producing the transfer medium. The producing apparatus can include an ink attaching unit in which ink is discharged from an ink jet head and attached to a substrate; an evaporation unit in which 65% to 95% by mass of the component excluding a solid content of the ink having been attached to the substrate is evaporated; and an adhesive liquid attaching unit in which adhesive liquid is discharged from the ink jet head and attached to a surface where the ink in which 65% to 95% by mass of the component excluding a solid content has been evaporated is attached.

Hereinafter, an example of the transfer medium producing apparatus used for the method of producing the transfer medium of the embodiment will be described according to FIGS. 1 to 6. In the following description of the specification, when a "front and rear direction, a "horizontal direction", or a "vertical direction" is mentioned, the direction indicates a direction based on the arrow shown in the drawings such as FIG. 1 and the like.

As shown in FIG. 1, a transfer medium producing apparatus 11 includes a rectangular body case 12. In the body case 12, there are provided a pay-out portion 14 paying out a film 13 as a long substrate, a printing chamber 15 in which the ink is discharged and attached to the film 13 to perform printing, an evaporation device 16 performing evaporation treatment on the film 13 to which the ink has been attached by printing, and a winding portion 17 winding the film 13 having undergone the evaporation treatment.

That is, in a position slightly above the central position in the vertical direction inside the body case 12, a planar plate-like base 18 dividing the inside of the body case 12 into an upper portion and a lower portion is provided, and a region above the base 18 becomes the printing chamber 15 which is created by supporting a rectangular plate-like platen 19 on the base 18. In a region below the base 18, the pay-out portion 14 is disposed in a left side position which becomes an upstream side in the transport direction of the film 13, and the evaporation device 16 and the winding portion 17 are disposed in a right side position which becomes a downstream side.

Figure 2:
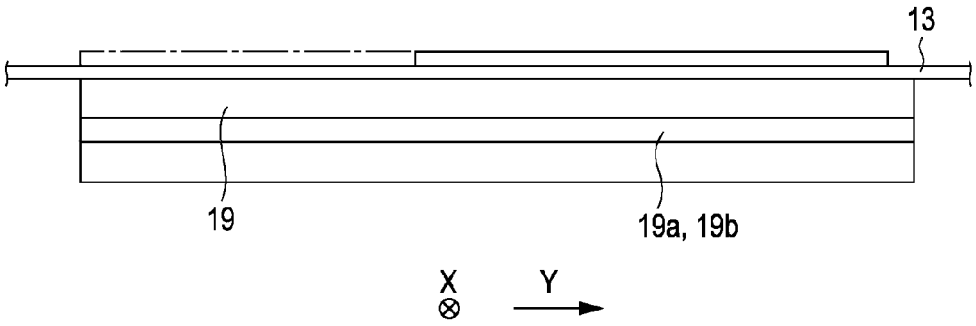
FIG. 2 is a lateral view illustrating the outline of a platen in an example of a transfer medium recording apparatus according to the embodiment.

As shown in FIG. 2, the platen 19 is provided with a platen heater 19*a* as an evaporation device for evaporating the component excluding solid content in the ink. Specifically, the platen heater 19*a* includes a nichrome wire 19*b* performing heating by heat conduction. The nichrome wire 19*b* is disposed inside the entire region of the platen 19 so as to be separated from the upper surface of the platen 19 by a constant distance. When current flows thereto, the nichrome wire 19*b* itself generates heat, and through the platen 19, the heat can be transmitted to the back surface of the film 13 on the platen 19, which contacts the platen 19.

In FIG. 2, X indicates a width direction in which a carriage 27 (FIG. 1) moves, and Y indicates a transport direction of the platen 19 (FIG. 1).

Herein, provided throughout the entire region of the platen 19, the nichrome wire 19*b* can generate heat throughout the entire region of the platen 19. In addition, the upper surface of the platen 19 is a smooth surface that does not have unevenness. Accordingly, the upper surface of the platen 19 can uniformly contact the film 13. The distance between the nichrome wire 19*b* and the upper surface of the platen 19 is constant. Therefore, heat can be uniformly conducted to the film 13 on the platen 19. That is, the film 13 can be uniformly heated.

As shown in FIG. 1, a winding axis 20 extending in the front and rear direction is rotatably provided in the pay-out portion 14. The film 13 is supported so as to be able to rotate integrally with the winding axis 20 while the film 13 is wound around the winding axis 20 in advance in a roll shape. That is, when the winding axis 20 rotates based on the driving force of a transport motor 55 (see FIG. 4), the film 13 is paid out from the pay-out portion 14 and transported to the downstream side in the transport direction. Thereafter, the film 13 paid out from the winding axis 20 is wound in order of a first roller 21, a second roller 22, a third roller 23, and a fourth roller 24 so as to change the transport direction, and then wound around a winding axis 25 which is provided in the winding portion 17 and rotates based on the driving force of the driving motor 55 (see FIG. 4).

The disposition position of each of the second roller 22 and the third roller 23, which face each other in the horizontal direction while interposing the platen 19 therebetween in the printing chamber 15, has been adjusted so that the top of the circumferential surface of each roller has the same height as the upper surface of the platen 19. Consequently, the back surface of the film 13 transported between the second roller 22 and the third roller 23 in the printing chamber 15 toward the downstream side comes into sliding contact with the upper surface of the platen 19.

As shown in FIG. 1, in both the front and rear sides of the platen 19 in the printing chamber 15, a guide rail 26 (indicated by the two-dot dashed line in FIG. 1) extending in the horizontal direction is provided so as to make a pair. The upper surface of the guide rail 26 is located above the upper surface of the platen 19, and in the upper surface of both guide rails 26, the rectangular carriage 27 is supported in a state where the carriage can reciprocate in the horizontal direction along both the guide rails 26 based on the driving of a driving mechanism (not shown). In the lower surface side of the carriage 27, an ink jet head 29 is supported through a supporting plate 28.

The ink jet head 29 performs printing by discharging ink to the film 13 supported on the platen 19 and functions as a liquid attaching unit discharging and attaching the adhesive liquid and the protective liquid to the film 13. In the printing chamber 15, a maintenance mechanism 30 for performing maintenance on the ink jet head 29 during non-printing time is provided in a region located at the right side of the third roller 23.

Figure 3:
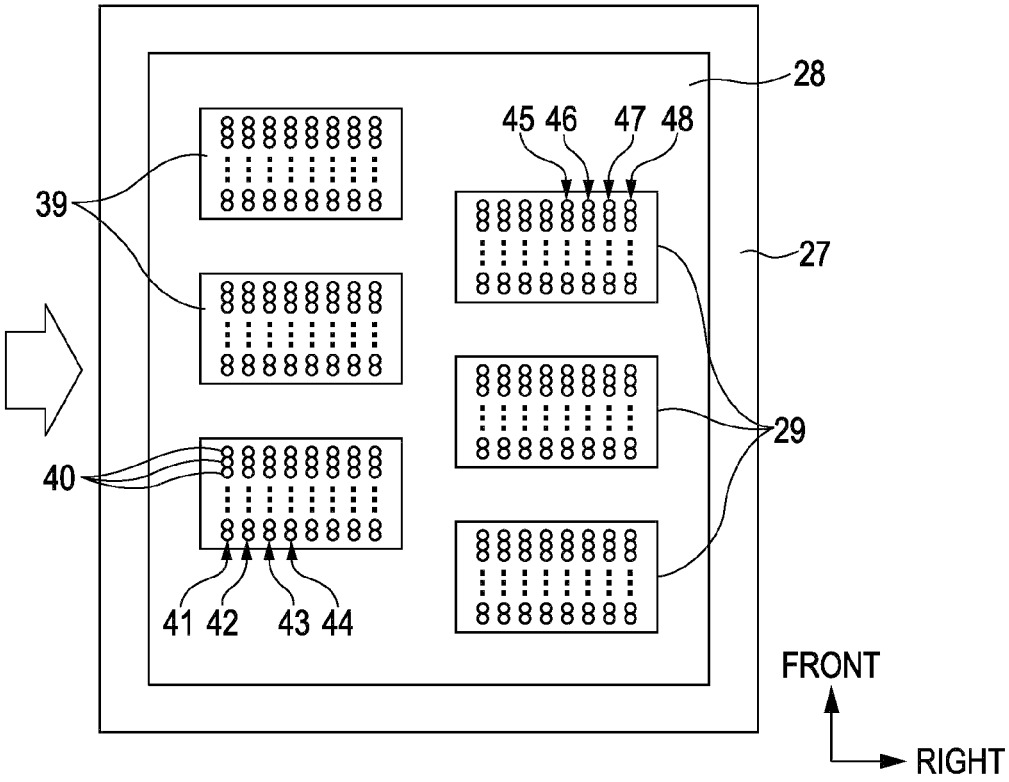
FIG. 3 is a schematic view illustrating a nozzle-formed surface of an ink jet head.

As shown in FIG. 3, in the supporting plate 28 supported in the lower surface side of the carriage 27, a plurality (6 in the embodiment) of the ink jet heads 29 is supported so as to be arranged in a zigzag manner over the width direction (front and rear direction) orthogonal to the transport direction (a direction indicated by the white arrow in FIG. 3) of the film 13. In a nozzle-formed surface 39 becoming the lower surface of each ink jet head 29, a plurality of columns (8 columns in the embodiment) of first to eighth nozzle columns 41 to 48 including a large number of nozzles 40 is regularly formed at a predetermined interval in the horizontal direction. To the first to eighth nozzle columns 41 to 48 configured in this manner, a plurality of types of liquid is respectively supplied from cartridges (omitted in the drawing) corresponding to each of the nozzle columns 41 to 48. The supplied liquid is discharged from each nozzle 40 according to the vibration of a piezoelectric device 49 (see FIG. 4) provided to correspond to each nozzle 40.

That is, to the first to fifth nozzle columns 41 to 45, the ink including the colorants of each color of cyan, magenta, yellow, black, and white is supplied in order from the first nozzle column 41 positioned in the furthest downstream side (left side) in the transport direction. To the sixth nozzle column 46 positioned in the sixth position from the left side, metallic ink is supplied. When the ink discharged from the first to sixth nozzle columns 41 to 46 is attached to the film 13, a colored layer 51 (see FIG. 6) as a pattern is formed. The metallic ink is ink which is obtained by dispersing a metallic pigment as a colorant in liquid and can form the metal foil-like colored layer 51 by being attached to the film 13.

The adhesive liquid is supplied to the seventh nozzle column 47 positioned in the seventh position from the left side. Moreover, to the eighth nozzle column 48 positioned at the furthest downstream side (right side) in the transport direction of the film 13, transparent protective liquid is supplied.

Figure 4:
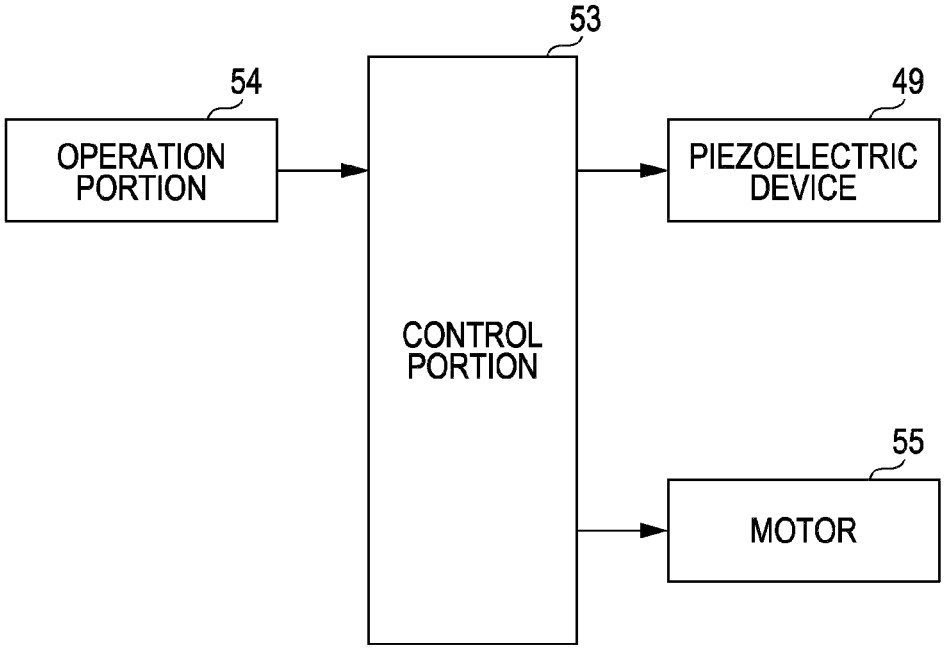
FIG. 4 is a block diagram of control configuration.

As shown in FIG. 4, the transfer medium producing apparatus 11 is provided with a control portion 53 including a microcomputer or the like which generally controls the driving of the transfer medium producing apparatus 11. The control portion 53 controls the driving of the piezoelectric device 49 and the transport motor 55, based on the input from an operation portion 54 that the user operates.

Next, the producing method in a case of producing a transfer medium 58 by using the transfer medium producing apparatus 11 will be described based on FIGS. 5 and 6. FIGS. 6A to 6D are views schematically illustrating the cross sections taken along the arrow VI-VI in FIG. 5.

Figure 6A:
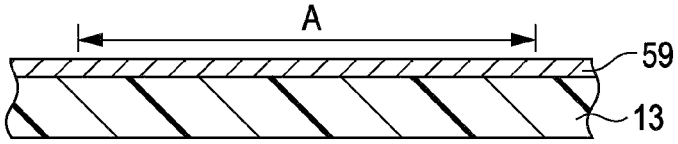
FIGS. 6A to 6D are cross-sectional views taken along the arrow line VI-VI in FIG. 5 and illustrate the production process of the transfer medium.

As shown in FIG. 6A, on the surface of the film 13 in the embodiment, a releasing layer 59 is formed. In addition, the film 13 is set in the transport path in a state where the end of the film to the downstream side in the transport direction is wound around the winding axis 25 at the production starting point of the transfer medium 58.

Figure 5:
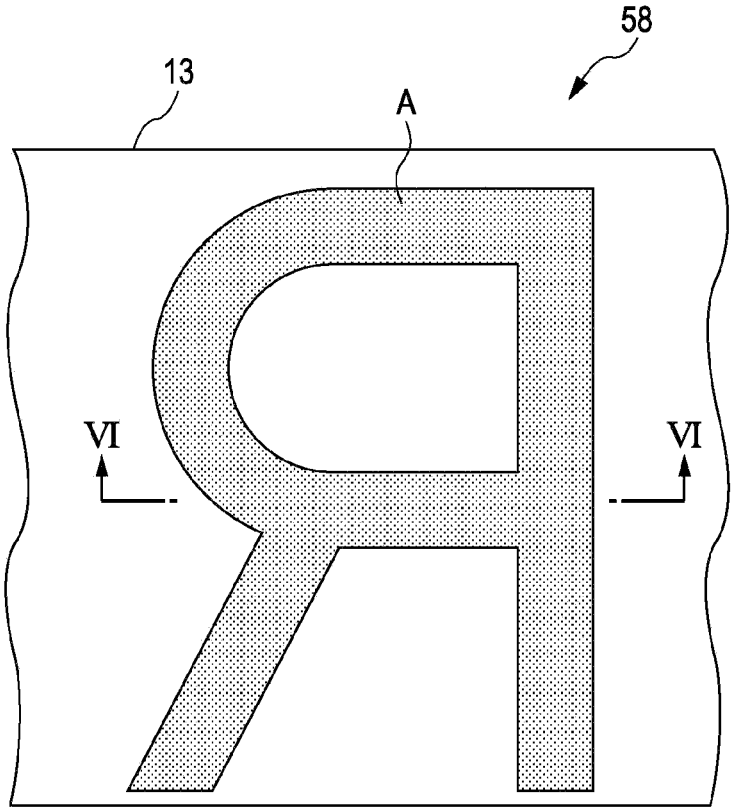
FIG. 5 is a schematic plan view of a transfer medium.

As shown in FIGS. 5 and 6A, when printing data such as the letter R is input as the printing data including letters or images forming patterns by the colored layer, first, the control portion 53 sets a transfer region A to which the ink is attached. The transfer medium 58 produced in the embodiment transfers a transfer image formed in the transfer medium 58 to the medium to be transferred (omitted in the drawing) as a target by mirror-reversing the transfer image. Therefore, the control portion 53 sets the transfer region A which is mirror-reversed with respect to the transferred transfer image.

When the user operates the operation portion 54 to start producing the transfer medium 58, the control portion 53 attaches the protective liquid, ink, and the adhesive liquid respectively to the film 13 by vibrating the piezoelectric device 49.

Figure 6B:
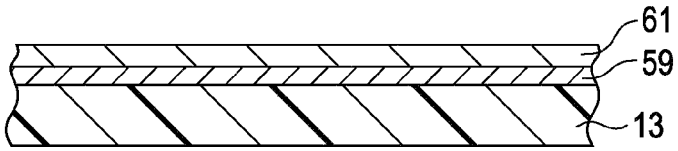

Specifically, first, the control portion 53 vibrates the piezoelectric device 49 corresponding to the eighth nozzle column 48 according to the movement of the carriage 27, thereby attaching the protective liquid to the transfer region A, as shown in FIG. 6B. In this manner, a protective layer 61 is formed on the film 13.

At this time, since the nichrome wire 19*b* of the platen heater 19*a* generates heat as described later, the protective liquid (protective layer 61) attached to the film 13 is heated through the film 13. As a result, while the component excluding the solid content is evaporated to some degree, a part of the component remains in the protective layer 61.

Figure 6C:
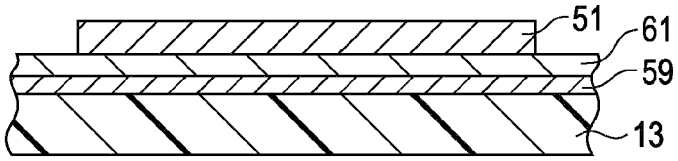

Subsequently, the control portion 53 vibrates the piezoelectric device 49 corresponding to the first to the sixth nozzle columns 41 to 46 according to the movement of the carriage 27, thereby forming the colored layer 51 by discharging and attaching the ink to the transfer region A in which the protective layer 61 has been formed, as shown in FIG. 6C (attaching ink). That is, when the transfer medium 58 for foil transfer is produced, the colored layer 51 is formed using the metallic ink. Specifically, first, the metallic ink is attached to the transfer region A, and then white ink is attached to the transfer region A, whereby the silver-colored layer 51 is formed.

Under the conditions which are preset so that at least a part of the liquid component in the colored layer 51, for example, 65% to 95% by mass of the liquid component is evaporated, the control portion 53 controls the nichrome wire 19*b* of the platen heater 19*a* to generate heat. As a result, the ink (colored layer 51) attached to the film 13 is heated through the film 13 and the protective layer 61 depending on the region, and a predetermined amount of the component (liquid component) excluding the solid content in the ink is evaporated (the first evaporation).

The platen heater 19*a* employs not a convection method but a heat conduction method. Therefore, there is no concern that the warm air will be directly blown to the first to eighth nozzle columns 41 to 48 of the ink jet head 29. As a result, there is no concern that the platen heater 19*a* will affect the state of the first to eighth nozzle columns 41 to 48 of the ink jet head 29. Specifically, there is no concern that a defective discharge will be caused by the viscosity increase of the ink which is caused when the ink in the nozzle is dried. In addition, the degree of heating performed by the platen heater 19*a* is lower than that of heating performed by the evaporation device 16. The degree is such a degree that there is no concern that the state of the first to eighth nozzle columns 41 to 48 of the ink jet head 29 will be affected by the heating.

Figure 6D:
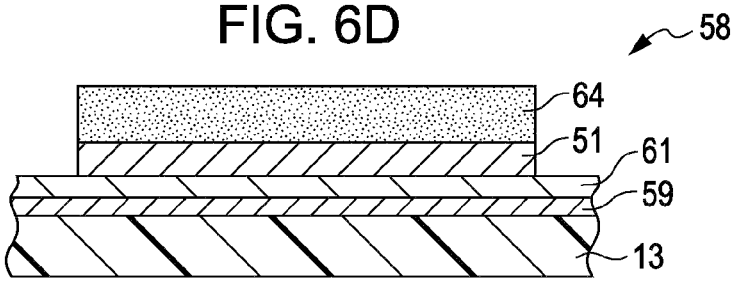

Next, the control portion 53 vibrates the piezoelectric device 49 corresponding to the seventh nozzle column 47 according to the movement of the carriage 27, thereby forming an adhesive layer 64 by discharging and attaching the adhesive liquid to the transfer region A, as shown in FIG. 6D (attaching adhesive liquid).

Herein, as shown in FIG. 6D, the colored layer 51 and the adhesive layer 64 are separated from each other. However, in the embodiment, the colored layer and the adhesive layer are not necessarily separated from each other (clearly). This is because the adhesive liquid is recorded in a state where the component to be evaporated included in the adhesive layer is not completely evaporated, in the embodiment. If the adhesive layer is provided in a state where the colored layer is not completely dried, it is expected that fixing strength will be improved by a so-called anchor effect.

When printing performed on the film 13 ends in the above-described manner, the control portion 53 transports the film 13 to the downstream side in the transport direction by driving the transport motor 55, and performs the evaporation treatment by using the evaporation device 16 (second evaporation). As a result, the component (liquid component) excluding the solid content included in the colored layer 51 and the adhesive layer 64 is evaporated, whereby the protective layer 61, colored layer 51, and adhesive layer 64 are finally fixed to the film 13. Thereafter, the film 13 is wound around the winding axis 25 so that the adhesive layer 64 contacts the back surface of the film 13.

When the adhesive liquid is obtained by dispersing the microcapsules in liquid, the temperature of the evaporation device 16 set to such a degree that the microcapsules in the adhesive layer 64 are not broken. Therefore, the adhesion between the back surface of the film 13 and the adhesive layer 64 is weaker than the adhesion between the protective layer 61, the colored layer 51, and the adhesive layer 64. Accordingly, when the wound film 13 is unwound, the back surface of the film 13 is separated from the adhesive layer 64, and the protective layer 61, colored layer 51, and adhesive layer 64 are formed into a laminated layer in this order from the film 13 side, on the surface of the film 13.

The adhesion between the protective layer 61, colored layer 51, and adhesive layer 64 is stronger than the adhesion between the protective layer 61 and the releasing layer 59. Accordingly, when the colored layer 51 is transferred to a target, first, an additional treatment is performed on the adhesive layer 64 to break the microcapsules. Subsequently, the adhesive layer 64 where the adhesiveness is expressed is adhered to the target, and the film 13 is peeled, whereby the releasing layer 59 and the protective layer 61 are peeled. As a result, the colored layer 51 is transferred to the target while the surface of the colored layer 51 is protected by the protective layer 61.

If the transfer medium producing apparatus 11 is used, the following effects can be obtained.

That is, in a state where at least a part of the component excluding the solid content, for example, 65% to 95% by mass of the component excluding the solid content is evaporated after the ink is attached to the film 13, if the adhesive liquid is attached to the colored layer 51, the adhesive liquid is attached in a state where the ink has lost the fluidity to some degree. Therefore, it is possible to attach the adhesive liquid without messing up the pattern of the colored layer 51 and to obtain the pattern of the colored layer with a high resolution. Moreover, when the ink is attached, a part of the component excluding the solid content can remain in the protective layer 61, and when the adhesive liquid is attached, a part of the liquid component can remain in the colored layer 51. Consequently, the adhesion between the protective layer 61, colored layer 51, and adhesive layer 64 is stronger than the adhesion between the protective layer 61 and the releasing layer 59. Therefore, it is possible to produce the transfer medium 58 that can excellently perform transfer on the target, by improving the adhesion particularly between the colored layer 51 and the adhesive layer 64.

By attaching the ink to the transfer region A to which the protective liquid has been attached, it is possible to protect the surface of the colored layer 51 with the protective layer 61, and to improve the durability of the colored layer 51 having been transferred to the target. Moreover, by attaching the ink in a state where a part of the component excluding the solid content remains in the protective layer 61, for example, it is possible to further enhance the adhesion compared to the colored layer 51 and the protective layer 61 in a case where the component excluding the solid content substantially does not remain in the protective layer 61.

By forming the protective layer 61 between the film 13 and the colored layer 51, it is possible to form the colored layer 51 regardless of the compatibility between the film 13 and the ink. That is, for example, even when printing is performed on the film 13 made of a resin having water repellency by using liquid (ink) colored with colorants including dyes or pigments, it is possible to improve the fixing property of the ink by forming the protective layer 61 using a transparent coating agent including inorganic fine particles such as silica or a swellable resin.

When the adhesive liquid is obtained by dispersing the microcapsules in liquid, if the adhesive liquid is discharged by vibrating the piezoelectric device 49, it is possible to attach the adhesive liquid to the film 13 in a state where the microcapsules are retained. That is, since it is possible to discharge the adhesive liquid in a state where the adhesion of the adhesive liquid has been reduced, the clogging of the ink jet nozzle can be suppressed.

The embodiment may be modified as follows. That is, a radiant heater embedded in the platen 19 and performing heating by radiating electromagnetic waves to the platen 19 may be provided instead of or in addition to the platen heater 19*a*, or an evaporation device such as a blower blowing air (warm air) may be provided. In addition, heads discharging the ink, protective liquid, and adhesive liquid may be separately provided. Furthermore, the protective liquid may not be attached, and the protective layer 61 may not be formed. Moreover, a film in which the protective layer has already been formed may be used. A mechanism discharging the releasing agent may be provided to the ink jet head 29 so as to form the releasing layer 59 by discharging the releasing agent to the film 13. In this case, the releasing layer 59 may be formed according to the shape of the colored layer 51 by discharging the releasing agent to the transfer region A.

The Constituent Component of Ink and Adhesive Liquid

Hereinafter, the constituent components of the ink and the adhesive liquid will be described in detail.

Pigment

As the pigment included in the ink, any of inorganic and organic pigments can be used.

As the inorganic pigment, carbon blacks (C.I. pigment black 7) such as furnace black, lamp black, acetylene black, channel black, iron oxide, and titanium oxide can be used.

Though not limited to the following examples, the specific examples of the carbon black include No. 2300, 900, MCF 88, No. 20B, No. 33, No. 40, No. 45, No. 52, MA 7, MA 8, MA 100, No. 2200B, and the like (all registered trade names, manufactured by Mitsubishi Chemical Corporation); Color Black FW 1, FW 2, FW 2V, FW 18, FW 200, S 150, S 160, S 170, Pretex 35, U, V, 140U, Special Black 6, 5, 4A, 4, 250, and the like (all registered trade names, manufactured by Degussa AG); Conductex SC, Raven 1255, 5750, 5250, 5000, 3500, 1255, 700, and the like (all registered trade names, manufactured by Columbian Carbon Co., Ltd.); and Regal 400R, 330R, 660R, Mogul L, Monarch 700, 800, 880, 900, 1000, 1100, 1300, 1400, Elftex 12, and the like (all registered trade name, manufactured by Cabot Corporation).

The carbon black may be used alone or in combination of two or more kinds thereof.

As the pigment included in achromatic white ink (white ink), one or more kinds selected from a group consisting of titanium oxide, barium sulfate, and hollow white resin emulsion are preferable.

Though not limited to the following examples, examples of the organic pigment for chromatic ink among the organic pigments include quinacridone-based pigment, quinacridone quinone-based pigment, dioxazine-based pigment, phthalocyanine-based pigment, anthrapyrimidine-based pigment, anthanthrone-based pigment, indanthrone-based pigment, flavanthrone-based pigment, perillen-based pigment, diketopyrrolopyrrole-based pigment, perinone-based pigment, quinophthalone-based pigment, anthraquinone-based pigment, thioindigo-based pigment, benzimidazolone-based pigment, isoindolinone-based pigment, azomethine-based pigment, and azo-based pigment.

Though not limited to the following examples, specific examples of the cyan pigment used for cyan ink include C.I. pigment blue 1, 2, 3, 15:3, 15:4, 15:34, 16, 22, 60, and the like; and C.I. vat blue 4, 60 and the like. Among these, one or more kinds selected from a group consisting of C.I. pigment blue 15:3, 15:4, and 60 are preferable.

Though not limited to the following examples, specific examples of the magenta pigment used for the magenta ink include C.I. pigment red 5, 7, 12, 48 (Ca), 48 (Mn), 57 (Ca), 57:1, 112, 122, 123, 168, 184, 202, C.I. pigment violet 19, and the like. Among these, one or more kinds selected from a group consisting of C.I. pigment red 122, 202, 209 and C.I. pigment violet 19 are preferable.

Though not limited to the following examples, specific examples of the yellow pigment used for the yellow ink include C.I. pigment yellow 1, 2, 3, 12, 13, 14C, 16, 17, 73, 74, 75, 83, 93, 95, 97, 98, 119, 110, 114, 128, 129, 138, 150, 151, 154, 155, 180, and 185. Among these, one or more kinds selected from a group consisting of C.I. pigment yellow 74, 109, 110, 128, and 138 are preferable.

Though not limited to the following examples, specific examples of the pigment used for the orange pigment dispersion liquid used for the orange ink include C.I. pigment orange 36 or 43, and a mixture thereof.

Though not limited to the following examples, specific examples of the pigment used for the green pigment dispersion liquid used for the green ink include C.I. pigment green 7 or 36, and a mixture thereof.

A metallic pigment used for the metallic ink is not particularly limited as long as the pigment has a function of metallic luster or the like. It is preferable that the pigment be aluminum or an aluminum alloy, or silver or a silver alloy. Among these, aluminum or the aluminum alloy is preferable since this material reduces cost and improves the metallic luster. When the aluminum alloy is used, other metallic elements or non-metallic elements that can be added to aluminum are not particularly limited as long as the elements have a function such as metallic luster, but the examples thereof include silver, gold, platinum, nickel, chromium, tin, zinc, indium, titanium, and copper. In addition, at least one kind of the single metal, an alloy thereof, and a mixture thereof is preferably used.

These pigments may be used by being dispersed in a resin using well-known dispersed resins, or may be used as a self dispersed pigment by oxidizing or sulfonating the pigment surface using ozone, hypochlorous acid, fuming sulfuric acid or the like.

Resin Emulsion, Water-Soluble Resin

In the embodiment, as the resin emulsion and the water-soluble resin that can be included in the ink and the adhesive liquid, the following ones are preferable. The resin may be used alone or in combination of two or more kinds thereof.

It is necessary that the resin has water dispersibility as described above even when the resin is water-insoluble resin. Therefore, it is preferable that the resin be a polymer including both the hydrophilic portion and hydrophobic portion, that is, a resin emulsion. When the resin emulsion is used as the thermoplastic resin, the average particle diameter is not particularly limited as long as the particles form an emulsion, but the average particle diameter is preferably about 150 nm or less, and more preferably about 5 nm to 100 nm.

In the specification, the average particle diameter is measured by means of a particle size analyzer using a dynamic light scattering method. Pure water is added to the emulsion to perform 100-fold dilution, and a 50% number average particle diameter measured by Nanotrac UPA-EX150 (manufactured by Nikkiso Co., Ltd.) is taken as the average particle diameter.

As the thermoplastic resin, it is possible to use the one that has been used for the ink and adhesive liquid for ink jet recording. Though not limited to the following examples, specific examples of the thermoplastic resin include poly (meth)acrylic acid ester or a copolymer thereof; polyacrylonitrile or a copolymer thereof; (meth)acrylic polymers such as polycyanoacrylate, polyacrylamide, and poly(meth) acrylic acid; polyethylene, polypropylene, polybutene, polyisobutylene, and polystyrene, or a copolymer thereof; a polyolefin-based polymer such as a petroleum resin, a coumarone-indene resin, and a terpene resin; a vinyl acetate or a vinyl alcohol-based polymer such as polyvinyl acetate or a copolymer thereof, polyvinyl alcohol, polyvinyl acetal, and polyvinyl ether; a halogen-containing polymer such as polyvinyl chloride or a copolymer thereof, polyvinylidene chloride, a fluororesin, and fluororubber; polyvinylcarbazole, polyvinylpyrrolidone, or a copolymer thereof; a nitrogen-containing vinyl-based polymer such as polyvinylpyridine, and polyvinylimidazole; a diene-based polymer such as polybutadiene or a copolymer thereof, polychloroprene, and polyisoprene (butyl rubber); and other ring-opening polymer type resins, condensation polymer type resins, and natural polymeric resin.

Examples of the commercially available product of the thermoplastic resin include Hitech E-7025P, Hitech E-2213, Hitech E-9460, Hitech E-9015, Hitech E-4A, Hitech E-5403P, and Hitech E-8237 (all registered trade name, manufactured by TOHO Chemical Industry Co., Ltd.); AQUACER 507, AQUACER 515, and AQUACER 840 (all registered trade names, manufactured by BYK Japan KK); and JONCRYL 67, 611, 680, and 690 (all registered trade names, manufactured by BASF).

When the thermoplastic resin is obtained in a state of an emulsion, it is possible to produce the emulsion by mixing a surfactant with resin particles and water as necessary. For example, the emulsion of the (meth)acrylic resin or styrene (meth)acrylic resin can be obtained by mixing the (meth) acrylic acid ester resin or the styrene (meth)acrylic acid ester resin with a (meth)acrylic acid resin, a surfactant, and water as necessary. The mixing ratio of at least any one of the resin emulsion and the water-soluble resin and the surfactant is preferably about 50:1 to 5:1 in general by a mass ratio. When the amount of the surfactant used is not in this range, it is difficult to form the emulsion. On the other hand, when the amount exceeds this range, the water resistance or the adhesion of the ink and the adhesive liquid tends to deteriorate or worsen.

The surfactant is not particularly limited, but preferable examples thereof include anionic surfactants such as sodium dodecylbenzenesulfonate, sodium laurate, and an ammonium salt of polyoxyethylene alkyl ether sulfate; and nonionic surfactants such as polyoxyethylene alkyl ether, polyoxyethylene alkyl ester, polyoxyethylene sorbitan fatty acid ester, polyoxyethylene alkylphenyl ether, polyoxyethylene alkyl amine, and polyoxyethylene alkyl amide. These surfactants may be used alone or as a mixture of two or more kinds thereof.

The emulsion of the thermoplastic resin can also be obtained by performing emulsion polymerization of a monomer of at least any one of the resin emulsion and the water-soluble resin in water containing a polymerization catalyst and an emulsifier. A polymerization initiator, the emulsifier, and a molecular weight modifier used in the emulsion polymerization can be used based on well-known methods.

As the polymerization initiator, the same initiator as the one used for the normal radical polymerization is used. Examples of the polymerization initiator include potassium persulfate, ammonium persulfate, hydrogen peroxide, azobisisobutyronitrile, benzoyl peroxide, dibutyl peroxide, peracetic acid, cumene hydroperoxide, t-butyl hydroperoxide, and paramethane hydroperoxide. When the polymerization reaction is performed in water, a water-soluble polymerization initiator is preferable. Examples of the emulsifier generally include anionic surfactants, nonionic surfactants, ones used as amphoteric surfactants, and a mixture thereof in addition to sodium lauryl sulfate. These may be used alone or as a mixture of two or more kinds thereof.

The proper ratio of water to at least any one of the resin emulsion and the water-soluble resin is preferably a range of 60 to 400 parts by mass, and more preferably a range of 100 to 200 parts by mass, based on the 100 parts by mass of the resins.

When the resin emulsion is used as the thermoplastic resin, well-known resin emulsion can also be used. For example, the resin emulsion disclosed in JP-B-62-1426, JP-A-3-56573, JP-A-3-79678, JP-A-3-160068, JP-A-4-18462 or the like can be used as it is.

It is also possible to use commercially available resin emulsions, and examples thereof include Microgel E-1002, E-5002 (all trade names, styrene-acrylic resin emulsion, manufactured by Nippon Paint Co., Ltd); Boncoat 4001 (trade name, acrylic resin emulsion, manufactured by DIC Corporation); JONCRYL 67, 611, 680, and 690 (all trade names, manufactured by BASF); AP-4735 (trade name, acrylic resin emulsion, manufactured by SHOWA HIGHPOLYMER CO., LTD.); AM 710 (trade name, acrylic resin emulsion, manufactured by SHOWA HIGHPOLYMER CO., LTD.); AM 920 (trade name, acrylic resin emulsion, manufactured by SHOWA HIGHPOLYMER CO., LTD.); Polysol AT 860 (trade name, acrylic resin emulsion, manufactured by SHOWA HIGHPOLYMER CO., LTD.); Boncoat 5454 (trade name, styrene-acrylic resin emulsion, manufactured by DIC Corporation); SAE 1014 (trade name, styrene-acrylic resin emulsion, manufactured by Zeon Corporation); and Saivinol SK-200 (trade name, acrylic resin emulsion, manufactured by SAIDEN CHEMICAL INDUSTRY CO., LTD). The thermoplastic resin may be mixed with other constituent components in the ink and adhesive liquid as particulate powder, but it is preferable that the resin particles be dispersed in an aqueous medium so as to be in a state of a resin emulsion, and then mixed with other constituent components of the ink and adhesive liquid. In order to obtain excellent long term storage stability and discharge stability of the ink and adhesive liquid, the particle diameter of the resin particles in the embodiment is preferably in a range of 5 nm to 400 nm, and more preferably in a range of 50 nm to 200 nm.

As the water-soluble resin, it is possible to use a synthetic polymer having ionic hydrophilic groups such as an alkali metal salt, an ammonium salt, an inorganic acid salt, and an organic acid salt with sulfonic acid groups, carboxylic acid groups, amino groups, and the like. More specifically, examples thereof include synthetic polymers such as polyethylene glycol, polyvinyl pyrrolidone, polyvinyl alcohol, polyvinyl acetal, a styrene-(meth)acrylic acid copolymer, a (meth)acrylic acid ester-(meth)acrylic acid copolymer, and the like. Examples of the commercially available product of the water-soluble resin include JONCRYL 680 (acrylic resin manufactured by BASF).

At least any one of the resin emulsion and the water-soluble resin is contained preferably in a range of 0.5% to 10.0% by mass in terms of solid content, based on the total amount (100% by mass) of the ink or the adhesive liquid. If too little of the resins is contained, the ink or adhesive liquid-coated layer formed on the substrate surface becomes too thin, so the adhesion between the layer and the substrate surface becomes insufficient in some cases. If the too much of the resins is contained, the discharge stability of the ink and the adhesive liquid deteriorates, the dispersion state of the resin becomes unstable during the storage of the ink and the adhesive liquid, or the uniformly coated layer cannot be formed since the resin aggregates or solidifies due to the slight evaporation of moisture, in some cases.

Water-Soluble Organic Solvent Having a Boiling Point of 70° C. to 250° C. at 1 atm If the ink (aqueous pigment ink) and the adhesive liquid contain the water-soluble organic solvent having a boiling point of 70° C. to 250° C. at 1 atm, the resin can be stabilized in the ink and the adhesive liquid, and the discharge stability and volatility of the ink (aqueous pigment ink) and the adhesive liquid become excellent; also, it is possible to effectively prevent the transfer unevenness of an image.

In order to make the water-soluble organic solvent exhibit the excellent discharge stability, it is preferable that the solvent be an aqueous liquid including one or more kinds selected from lactams, carboxylic acid esters, alkylene glycol ethers, and alcohols. Among these, an aqueous liquid including 2-pyrrolidones (γ-butyrolactams), lactic acid esters, alkylene glycol ethers, and alcohols is preferable.

Examples of the water-soluble organic solvent include, but are not limited to, ethanol (boiling point of 78° C.), N-methyl-2-pyrrolidone (boiling point of 202° C.), N-methyl-2-pyrrolidone (boiling point of 212° C.), 2-pyrrolidone (boiling point of 245° C.), dimethyl sulfoxide (boiling point of 189° C.), methyl lactate (boiling point of 145° C.), ethyl lactate (boiling point of 155° C.), isopropyl lactate (boiling point of 168° C.), butyl lactate (boiling point of 188° C.), ethylene glycol monomethyl ether (boiling point of 124° C.), ethylene glycol dimethyl ether (boiling point of 85° C.), ethylene glycol monomethyl ether acetate (boiling point of 145° C.), diethylene glycol monomethyl ether (boiling point of 194° C.), diethylene glycol dimethyl ether (boiling point of 162° C.), diethylene glycol ethylmethyl ether (boiling point of 176° C.), diethylene glycol diethyl ether (boiling point of 189° C.), propylene glycol monomethyl ether (boiling point of 120° C.), propylene glycol dimethyl ether (boiling point of 97° C.), dipropylene glycol monomethyl ether (boiling point of 188° C.), dipropylene glycol dimethyl ether (boiling point of 171° C.), 1,4-dioxane (boiling point of 101° C.), ethylene glycol (boiling point of 197° C.), diethylene glycol (boiling point of 244° C.), propylene glycol (boiling point of 188° C.), dipropylene glycol (boiling point of 232° C.), 1,3-propanediol (boiling point of 212° C.), 1,4-butanediol (boiling point of 230° C.), hexylene glycol (boiling point of 198° C.), 2,3-butanediol (boiling point of 77° C.), n-butanol (boiling point of 118° C.), 1,2-hexanediol (boiling point of 224° C.), 1,2-pentanediol (boiling point of 206° C.), diethylene glycol monobutyl ether (boiling point of 116° C.), and diethylene glycol monopropyl ether (boiling point of 153° C.).

The water-soluble organic solvent having a boiling point of 70° C. to 250° C. at 1 atm may be used alone or as a mixture of two or more kinds thereof.

Surfactant

In the embodiment, examples of the surfactant used for ink include one or more kinds of surfactant selected from a group consisting of acetylene glycol-based surfactant and silicone-based surfactant.

Examples of the acetylene glycol-based surfactant include 2,4,7,9-tetramethyl-5-decyne-4,7-diol, 3,6-dimethyl-4-octyne-3,6-diol, 3,5-dimethyl-1-hexyne-3-ol, and 2,4-dimethyl-5-hexyne-3-ol. As commercially available products of the acetylene glycol-based surfactant, for example, Olfin E1010, STG, Y, Surfynol 104E, 104H, 104A, 104BC, 104DPM, 104PA, 104PG-50, 104S, 420, 465, 485, TG, SE, SE-F, 61, 82, and DF-110D (all trade names, manufactured by Nissin Chemical Industry CO., Ltd); and Acetylenol E00, and E00P (all trade names, manufactured by Kawaken Fine Chemicals Co., Ltd.) can be used.

As the silicone-based surfactant, a polysiloxane-based compound is preferably used. Specific examples of the polysiloxane-based compound include polyether-modified organosiloxane. As commercially available products of the silicone-based surfactant, BYK-306, BYK-307, BYK-333, BYK-341, BYK-345, BYK-346, BYK-347, BYK-348, BYK-UV3500, 3510, 3530, and 3570 (all trade names, manufactured by BYK Japan KK) can be used.

Particularly, a surfactant including a combination of the silicone-based surfactant and the acetylene glycol-based surfactant having an HLB value of 17 or less is preferable.

It is preferable to adjust the surface tension of the ink within a range of 23.0 mN/m to 40.0 mN/m, and more preferably within a range of 25.0 mN/m to 35.0 mN/m, by combining the water-soluble organic solvent and the surfactant. If the surface tension of the ink is in this range, the discharge stability becomes excellent.

Water

Water is a main solvent when the ink used in the embodiment is aqueous ink, and is also included in the adhesive liquid. As the water, in order to reduce ionic impurities as much as possible, it is preferable to use ion-change water, ultrafiltration water, reverse osmosis water, pure water such as distilled water, or ultrapure water. In addition, if water sterilized by ultraviolet irradiation or the addition of hydrogen peroxide is used, it is possible to prevent the generation of mold or bacteria when the pigment dispersion liquid or the ink using the same are stored for a long time, which thus is preferable.

Other Additives

The ink and the adhesive liquid of the embodiment may further include a preservative, a fungicide, a pH adjustor, an antioxidant, a metal trapping agent, and the like as necessary.

Examples of the preservative and the fungicide include sodium benzoate, sodium pentachlorophenol, sodium 2-pyridinethiol-1-oxide, sodium sorbate, sodium dehydroacetate, and 1,2-dibenzisothiazolin-3-one (Proxel-CRL, Proxel-BDN, Proxel-GXL, Proxel-XL2, and Proxel-TN manufactured by Arch Chemicals).

Examples of the pH adjustor include inorganic alkalis such as sodium hydroxide and potassium hydroxide; ammonia, diethanolamine, triethanolamine, triisopropanolamine, morpholine, monopotassium phosphate, and sodium hydrogenphosphate.

Examples of the metal trapping agent include ethylenediaminetetraacetic acid disodium salt.

As described above, according to the embodiment, the ink for forming the colored layer and the adhesive liquid for forming the adhesive layer exhibit excellent discharge stability when being discharged from the ink jet head, the pattern of the colored layer can be obtained with a high resolution, and it is possible to provide a method of producing the transfer medium having an excellent transfer property and adhesiveness after transfer.

The producing method in the embodiment may include, prior to the attaching of ink described above, forming a protective layer on the substrate surface at the side of the substrate where the colored layer is supposed to be formed. The protective layer is formed by attaching a protective liquid to the substrate surface and drying the liquid as necessary, for example. Forming the protective layer makes it possible to protect the surface of the colored layer after transfer by using the protective layer and to improve the durability of the colored layer transferred to the medium to be transferred (target). Examples of the protective liquid include liquids including an acrylic acid ester resin, a methacrylic acid ester resin, an acrylic acid ester-methacrylic acid ester copolymer resin, an acrylic acid ester-styrene copolymer resin, an acrylic acid ester-methacrylic acid ester-styrene copolymer resin, and a polyvinyl alcohol resin.

Set of Ink and Adhesive Liquid

An embodiment of the invention relates to a set of ink and adhesive liquid. The set is a set of ink preferably including a pigment, a resin, and a solvent and adhesive liquid preferably including a resin and a solvent. In the set, the content ratio of the resin in the ink can be smaller than the content ratio of the resin in the adhesive liquid. When the set is used in producing the transfer medium, advantageous effects of the invention can be obtained, so the set is useful. The ink and each component included therein as well as the adhesive liquid and each component included therein may be the same as the ones described above, so the detailed description thereof will be omitted herein.

Transfer Medium

Another embodiment of the invention relates to a transfer medium. The transfer medium can be obtained through the producing method of the embodiment. For example, the transfer medium can have a characteristic in which the resin amount in the colored layer originated from the ink is smaller than the resin amount in the adhesive layer originated from the adhesive liquid. As a result, it is possible to provide a transfer medium for which the adhesiveness between the medium to be transferred or the colored layer and the adhesive layer becomes extremely excellent after transfer.

In the transfer medium, the thickness of the colored layer is preferably 1 μm to 10 μm. If the thickness of the colored layer is in this range, color developability becomes excellent. The thickness of the adhesive layer is preferably 1 μm to 5 μm. If the thickness of the adhesive layer is in this range of the numerical values, the adhesiveness becomes excellent. Moreover, when the transfer medium includes a protective layer, the thickness of the protective layer is preferably 10 nm to 30 nm. The thickness of the protective layer is in this range is excellent in respect that the volume of the layer does not increase when a roll-like substrate is used, the colored layer is protected, or the production costs of the protective layer are reduced.

EXAMPLES

Hereinafter, examples of the invention will be described in detail, but the invention is not limited thereto.

Embodiment A

Preparation of Ink

Ink A1

3 parts by mass of diethylene glycol monobutyl ether (DEGBE), 0.8 parts by mass of silicone-based surfactant (BYK-348, manufactured by BYK Japan KK), and 30 parts by mass of pure water (ion exchange water) were mixed, followed by stirring for 20 minutes at ambient temperature, thereby obtaining a premixed solution. Thereafter, 1.5 parts by mass of a water-soluble resin (JONCRYL 680, acrylic resin having a molecular weight of 4,900 and an acid value of 215, manufactured by BASF) as a pigment dispersant, and 0.1% by mass of potassium hydroxide (KOH) as a pH adjustor were added to the premixed solution, followed by stirring for 1 hour at 40° C., thereby preparing a mixed solution A-I.

5 parts by mass of a magenta pigment (C.I. pigment red 122, manufactured by BASF) was added to the prepared mixed solution A-I to obtain a mixed solution A-II. In a table sand mill (manufactured by Hayashi Shoten), the mixed solution A-II was stirred together with zirconia glass beads (diameter of 1.5 mm) of 1.5 times of the mass of the obtained mixed solution A-II for 2 hours at 2,160 rpm so as to be dispersed. After dispersion, the resultant was filtered through an SUS mesh filter having a diameter of 0.1 mm, thereby preparing a dispersion liquid A-I.

1,2-Hexanediol (1,2-HD), 2-pyrrolidone (simply shown as "pyrrolidone" in Table 1), propylene glycol (PG), Proxel-XL2 (preservative, manufactured by Arch Chemicals) and pure water (ion exchange water) were added to the prepared dispersion liquid A-I in the amounts (parts by mass) shown in Table 1, followed by stirring for 20 minutes at 40° C., thereby obtaining a dispersion liquid A-II. After the stirring, the dispersion liquid A-II was filtered through a membrane filter having a diameter of 5 μm, thereby preparing an ink A1 having the composition shown in Table 1.

Ink A2

An ink A2 having the composition shown in Table 1 was prepared in the same manner as the ink A1, except that the amount of the water-soluble resin added as the pigment dispersant in preparing the mixed solution A-I was changed to 2 parts by mass, and that the magenta pigment added to the mixed solution A-I in preparing the dispersion liquid A-I was changed to 4 parts by mass of a yellow pigment (C.I. pigment yellow 180, manufactured by Dainichiseika Color & Chemicals Mfg. Co., Ltd.).

Ink A3

An ink A3 having the composition shown in Table 1 was prepared in the same manner as the ink A1, except that the amount of the water-soluble resin added as the pigment dispersant in preparing the mixed solution A-I was changed to 2 parts by mass, the amount of the BYK-348 added was changed to 0.5 parts by mass, the magenta pigment added to the mixed solution A-I in preparing the dispersion liquid A-I was changed to a cyan pigment (C.I. pigment blue 15:3, manufactured by DIC Corporation), and that 1,2-hexanediol, 2-pyrrolidone, propylene glycol, acrylic resin emulsion (AP-4735, 50% active ingredient, manufactured by SHOWA HIGHPOLYMER CO., LTD.) (simply shown as a "resin EM" in Table 1), an acetylene glycol-based surfactant (Surfynol 465, HLB value of 13, manufactured by Air Products and Chemicals Inc.) (simply shown as "465" in Table 1), Proxel-XL2, and pure water (ion exchange water) were added to the prepared dispersion liquid A-I in the amounts (parts by mass) shown in Table 1, followed by stirring for 20 minutes at 40° C., thereby obtaining the dispersion liquid A-II.

TABLE 1

| | | Resin | | Water-soluble organic solvent of a medium boiling point | | | | Surfactant | | pH adjustor | Preservative | Pure |
|---|---|---|---|---|---|---|---|---|---|---|---|---|
| | Pigment | Water-soluble resin | Resin EM | DEGBE | 1,2-HD | Pyrrolidone | PG | BYK-348 | 465 | KOH | Proxel-XL2 | water |
| Ink 1 | 5 | 1.5 | — | 3 | 4 | 3 | 12 | 0.8 | — | 0.1 | 0.2 | 70.4 |
| Ink 2 | 4 | 2 | — | 3 | 4 | 3 | 12 | 0.8 | — | 0.1 | 0.2 | 70.9 |
| Ink 3 | 5 | 2 | 0.6 | 3 | 10 | 5 | 5 | 0.5 | 1.5 | 0.1 | 0.2 | 67.1 |

Preparation of Adhesive Liquid

Adhesive Liquid A1

1,2-Hexanediol (1,2-HD), 2-pyrrolidone (simply shown as "pyrrolidone" in Table 2), propylene glycol (PG), AM 710 (acrylic resin emulsion, 50.5% active ingredient, manufactured by SHOWA HIGHPOLYMER CO., LTD.) (simply shown as "resin EM" in Table 2), and pure water (ion exchange water) were mixed, followed by stirring for 20 minutes at 40° C. and filtration through a membrane filter having a diameter of 5 μm, thereby preparing adhesive liquid A1 shown in the following Table 2.

Adhesive Liquid A2

1,2-Hexanediol, 2-pyrrolidone, propylene glycol, AM 920 (acrylic resin emulsion, 45% active ingredient, manufactured by SHOWA HIGHPOLYMER CO., LTD.), and pure water (ion exchange water) were mixed, followed by stirring for 20 minutes at 40° C. and filtration through a membrane filter having a diameter of 5 μm, thereby preparing adhesive liquid A2 shown in the following Table 2.

Adhesive Liquid A3

1,2-Hexanediol, 2-pyrrolidone, propylene glycol, Polysol AT860 (acrylic resin emulsion, 50% active ingredient, manufactured by SHOWA HIGHPOLYMER CO., LTD.), and pure water (ion exchange water) were mixed, followed by stirring for 20 minutes at 40° C. and filtration through a membrane filter having a diameter of 5 μm, thereby preparing adhesive liquid A3 shown in the following Table 2.

TABLE 2

| | Resin | Water-soluble organic solvent of a medium boiling point | | | Surfactant | Pure |
|---|---|---|---|---|---|---|
| | Resin EM | 1,2-HD | Pyrrolidone | PG | BYK-348 | water |
| Adhesive liquid 1 | 8 | 5 | 4 | 12 | 1 | 71 |
| Adhesive liquid 2 | 2.5 | 20 | 15 | 5 | 1 | 57.5 |
| Adhesive liquid 3 | 25 | 2 | — | 8 | 1 | 65 |

Preparing Ink Jet Head Discharge

The ink jet head discharge experiment for the inks A1 to A3 and adhesive liquid A1 to A3 was performed using PX-7550 (an ink jet printer, manufactured by Seiko Epson Corporation). However, the invention is not limited by the experiment.

The inks A1 to A3 and adhesive liquids A1 to A3 were prepared by being filled in cartridges of mat black, and the cartridges were installed in each printer, thereby performing an operation of filling ink jet heads. Subsequently, it was checked if the ink jet head performed discharge, whereby printing was ready.

Discharge Stability Evaluation

In the environment of a temperature of 25° C. and a relative humidity of 40% RH, the ink and the adhesive liquid were continuously discharged from the ink jet head. As the discharge conditions, driving frequency was set to 50 kHz, and a 100% duty (commonly-called solid printing) was set in a resolution of 1440 dpi×1440 dpi. The "duty" herein is a value calculated by the following formula.

$$\text{Duty}(\%)=\text{recorded actual number of dots}/(\text{vertical resolution}\times\text{horizontal resolution})\times 100$$

(In the formula, the "recorded actual number of dots" is the actual number of dots recorded per unit area, and the "vertical resolution" and the "horizontal resolution" are resolution per unit area respectively)

The evaluation criteria were as follows, and the evaluated results are shown in the following Table 3.

A: Dot omission or flight curves did not occur even after 15 minutes, or occurred within 15 minutes but recovery was possible by a cleaning operation.

C: Dot omission or flight curves occurred within 15 minutes and recovery was not possible even with the cleaning operation.

TABLE 3

| | Discharge stability |
|---|---|
| Ink 1 | A |
| Ink 2 | A |
| Ink 3 | A |
| Adhesive liquid 1 | A |
| Adhesive liquid 2 | A |
| Adhesive liquid 3 | A |

From the results in Table 3, it was confirmed that all of the prepared inks A1 to A3 and adhesive liquids A1 to A3 were excellent in discharge stability.

Preparation of Transfer Medium

By using a transfer medium producing apparatus which includes the same configuration as shown in FIG. 1 and an evaporation device for evaporating components excluding the solid content in the ink, the transfer medium was prepared. Specifically, first, on a roll-like biaxially extended PET film having a width of 600 mm and a thickness of 12 μm, a polyethylene wax was coated with a film thickness of 20 nm, thereby preparing a releasing layer. In addition, a thermoplastic melamine resin layer was coated thereon with a thickness of 10 nm, followed by thermal curing for 5 minutes at 180° C., thereby preparing a protective layer. In this manner, a transfer film base medium was prepared. Next, this transfer film base medium was installed in a predetermined position in the transfer medium producing apparatus, and the mass of droplets of 5 ng to 15 ng was appropriately adjusted by changing a piezo device-driving voltage waveform of the ink jet head. Thereafter, using a software program for recording, letters and image patterns were printed at a resolution of 2,880 dpi×1,440 dpi. As the letters, 5 point and 7 point of em Hiragana (font: MS Mincho) was used.

Printing was performed in the following order. First, the ink shown in Table 4 was discharged from the ink jet head and then attached, thereby forming the colored layer. As the first evaporation, the substrate was heated at 50° C. by a platen heater from the back surface of the substrate, and the colored layer was exposed to warm air at 40° C., whereby the liquid component was evaporated from the attached ink. Thereafter, when the component (liquid component) excluding the solid content in the ink reached a desired amount described later, the adhesive liquid shown in Table 4 was discharged as 4 ng of droplets from the ink jet head toward the side of the substrate where the colored layer was formed and attached thereto, thereby forming the adhesive layer. The adhesive layer was formed using the software program for recording in 100% duty (so-called solid printing) at a resolution of 1,440 dpi×1,440 dpi. Subsequently, as the second evaporation, evaporation and drying (in which the adhesive layer was exposed to warm air of 50° C. for 20 seconds) were further performed, thereby preparing the transfer medium.

1. First Evaporation Example A1

70% by mass of the component excluding the solid content in the ink I was evaporated.

2. First Evaporation Example A2

80% by mass of the component excluding the solid content in the ink A2 was evaporated.

3. First Evaporation Example A3

90% by mass of the component excluding the solid content in the ink A3 was evaporated.

4. First Evaporation Example A4

65% by mass of the component excluding the solid content in the ink A1 was evaporated.

5. First Evaporation Example A5

95% by mass of the component excluding the solid content in the ink A1 was evaporated.

Evaluation of Printing Resolution

The evaluation criteria were as follows, and the evaluated results are shown in the following Table 4.

A: Letters of 5 points or less could be read clearly.

B: Letters of 5 point could not be read, but letters of 7 point could be read clearly.

C: Letters of 7 points or less could not be read.

Transfer Property Evaluation

The transfer medium slit-processed into a 100 mm width was installed in a predetermined position of a hot stamping machine (R415F-TP, roll-on type, manufactured by AMAGASAKI MACHINERY Co., Ltd), and the transfer medium was transferred to an acrylic resin plate as a medium to be transferred at a heat compression roller temperature of 150° C., pressure of 30 kg/cm$^2$, and speed of 20 cm/second.

The evaluation criteria were as follows, and the evaluated results are shown in the following Table 4.

A: Letters of 5 points or less could be completely transferred.

B: Letters of 5 points or less were transferred incompletely.

TABLE 4

| | Ink number | Adhesive liquid number | Evaporated amount of component excluding solid content | Printing resolution | Transfer property |
|---|---|---|---|---|---|
| First evaporation example 1 | 1 | 1 | 70% by mass | A | A |
| First evaporation example 2 | 2 | 2 | 80% by mass | A | A |
| First evaporation example 3 | 3 | 3 | 90% by mass | A | A |
| First evaporation example 4 | 1 | 1 | 65% by mass | B | — |
| First evaporation example 5 | 1 | 1 | 95% by mass | A | B |

The results in Table 4 clearly showed that by using the ink and adhesive liquid having excellent discharge stability, and by discharging and attaching the adhesive liquid after 65% to 95% by mass of the liquid component of the ink which had been discharged and attached to the substrate was evaporated, printing could be performed with a high resolution (the pattern of the colored layer in the transfer medium could be formed with a high resolution), and the excellent transfer property was obtained.

Embodiment B

Preparation of Ink

Ink B1

3 parts by mass of diethylene glycol monobutyl ether (DEGBE), 0.8 parts by mass of silicone-based surfactant (BYK-348, manufactured by BYK Japan KK), and 30 parts by mass of pure water (ion exchange water) were mixed, followed by stirring for 20 minutes at ambient temperature, thereby obtaining a premixed solution. Thereafter, 1.5 parts by mass of a water-soluble resin (JONCRYL 680, acrylic resin having a molecular weight of 4,900 and an acid value of 215, manufactured by BASF) as a pigment dispersant, and 0.1% by mass of potassium hydroxide (KOH) as a pH adjustor were added to the premixed solution, followed by stirring for 1 hour at 40° C., thereby preparing a mixed solution B-I.

5 parts by mass of a magenta pigment (C.I. pigment red 122, manufactured by BASF) was added to the prepared mixed solution B-I to obtain a mixed solution B-II. In a table sand mill (manufactured by Hayashi Shoten), the mixed solution B-II was stirred together with zirconia glass beads (diameter of 1.5 mm) of 1.5 times of the mass of the obtained mixed solution B-II for 2 hours at 2,160 rpm so as to be dispersed. After dispersion, the resultant was filtered through an SUS mesh filter having a diameter of 0.1 mm, thereby preparing a dispersion liquid B-I.

1,2-Hexanediol (1,2-HD), 2-pyrrolidone (simply shown as "pyrrolidone" in Table 5), propylene glycol (PG), Proxel-XL2 (preservative, manufactured by Arch Chemicals) and pure water (ion exchange water) were added to the prepared dispersion liquid B-I in the amounts (parts by mass) shown in Table 5, followed by stirring for 20 minutes at 40° C., thereby obtaining a dispersion liquid B-II. After the stirring, the dispersion liquid B-II was filtered through a membrane filter having a diameter of 5 μm, thereby preparing an ink B1 having the composition shown in Table 5.

Ink B2

An ink B2 having the composition shown in Table 5 was prepared in the same manner as the ink B1, except that the amount of the water-soluble resin added as the pigment dispersant in preparing the mixed solution B-I was changed to 2.0 parts by mass, and that the magenta pigment added to the mixed solution B-I in preparing the dispersion liquid B-I was changed to 4 parts by mass of a yellow pigment (C.I. pigment yellow 180, manufactured by Dainichiseika Color & Chemicals Mfg. Co., Ltd.)

Ink B3

An ink B3 having the composition shown in Table 5 was prepared in the same manner as the ink B1, except that the amount of the water-soluble resin added as the pigment dispersant in preparing the mixed solution B-I was changed to 1.4 parts by mass, the amount of the BYK-348 added was changed to 0.5 parts by mass, the magenta pigment added to the mixed solution B-I in preparing the dispersion liquid B-I was changed to a cyan pigment (C.I. pigment blue 15:3, manufactured by DIC Corporation), and that 1,2-hexanediol, 2-pyrrolidone, propylene glycol, acrylic resin emulsion (AP-4735, 50% active ingredient, manufactured by SHOWA HIGHPOLYMER CO., LTD.) (simply shown as a "resin EM" in Table 5), an acetylene glycol-based surfactant (Surfynol 465, HLB value of 13, manufactured by Air Products and Chemicals Inc.) (simply shown as "465" in Table 1), Proxel-XL2, and pure water (ion exchange water) were added to the prepared dispersion liquid B-I in the amounts (parts by mass) shown in Table 5, followed by stirring for 20 minutes at 40° C., thereby obtaining the dispersion liquid B-II.

TABLE 5

| | | Resin | | Water-soluble organic solvent of a medium boiling point | | | | Surfactant | | pH adjustor | Preservative | Pure |
|---|---|---|---|---|---|---|---|---|---|---|---|---|
| | Pigment | Water-soluble resin | Resin EM | DEGBE | 1,2-HD | Pyrrolidone | PG | BYK-348 | 465 | KOH | Proxel-XL2 | water |
| Ink 1 | 5 | 1.5 | — | 3 | 4 | 3 | 12 | 0.8 | — | 0.1 | 0.2 | 70.4 |
| Ink 2 | 4 | 2.0 | — | 3 | 4 | 3 | 12 | 0.8 | — | 0.1 | 0.2 | 70.9 |
| Ink 3 | 5 | 1.4 | 0.6 | 3 | 10 | 5 | 5 | 0.5 | 1.5 | 0.1 | 0.2 | 67.7 |

Preparation of Adhesive Liquid

Adhesive Liquid B1

1,2-Hexanediol (1,2-HD), 2-pyrrolidone (simply shown as "pyrrolidone" in Table 2), propylene glycol (PG), AM 710 (acrylic resin emulsion, 50.5% active ingredient, manufactured by SHOWA HIGHPOLYMER CO., LTD.) (simply shown as "resin EM" in Table 6), and pure water (ion exchange water) were mixed, followed by stirring for 20 minutes at 40° C. and filtration through a membrane filter having a diameter of 5 μm, thereby preparing adhesive liquid B1 shown in the following Table 6.

Adhesive Liquid B2

1,2-Hexanediol, 2-pyrrolidone, propylene glycol, AM 920 (acrylic resin emulsion, 45% of active ingredient, manufactured by SHOWA HIGHPOLYMER CO., LTD.), and pure water (ion exchange water) were mixed, followed by stirring for 20 minutes at 40° C. and filtration through a membrane filter having a diameter of 5 μm, thereby preparing adhesive liquid B2 shown in the following Table 6.

Adhesive Liquid B3

1,2-Hexanediol, 2-pyrrolidone, propylene glycol, Polysol AT860 (acrylic resin emulsion, 50% active ingredient, manufactured by SHOWA HIGHPOLYMER CO., LTD.), and pure water (ion exchange water) were mixed, followed by stirring for 20 minutes at 40° C. and filtration through a membrane filter having a diameter of 5 μm, thereby preparing adhesive liquid B3 shown in the following Table 6.

Adhesive Liquid B4

1,2-Hexanediol, 2-pyrrolidone, propylene glycol, AM 920 (acrylic resin emulsion, 45% active ingredient, manufactured by SHOWA HIGHPOLYMER CO., LTD.), and pure water (ion exchange water) were mixed, followed by stirring for 20 minutes at 40° C. and filtration through a membrane filter having a diameter of 5 μm, thereby preparing adhesive liquid B4 shown in the following Table 6.

TABLE 6

| | Resin | Water-soluble organic solvent of a medium boiling point | | | | | |
|---|---|---|---|---|---|---|---|
| | Resin EM | 1,2-HD | Pyrrolidone | PG | Ethanol | Surfactant BYK-348 | Pure water |
| Adhesive liquid 1 | 8.0 | 5 | 4 | 12 | — | 1 | 71 |
| Adhesive liquid 2 | 2.5 | 20 | 15 | 5 | — | 1 | 57.5 |
| Adhesive liquid 3 | 25.0 | 2 | — | 8 | — | 1 | 65 |
| Adhesive liquid 4 | 3 | 13 | 15 | 5 | 3 | 1 | 61 |

Preparing Ink Jet Head Discharge

The ink jet head discharge experiment for the inks B1 to B3 and adhesive liquid B1 to B4 was performed using PX-7550 (an ink jet printer, manufactured by Seiko Epson Corporation). However, the invention is not limited by the experiment.

The inks B1 to B3 were prepared by being filled in cartridges of mat black, the adhesive liquids B1 to B4 were prepared by being filled in a yellow ink cartilage, and the cartridges were installed in each printer, thereby performing an operation of filling ink jet heads. Subsequently, it was checked if the ink jet head performed discharge, whereby printing was ready.

Discharge Stability Estimation

In the environment of a temperature of 25° C. and a relative humidity of 40% RH, the ink and the adhesive liquid were continuously discharged from the ink jet head. As the discharge conditions, a driving frequency was set to 50 kHz, and a 100% duty (commonly-called solid printing) was set in a resolution of 1440 dpi×1440 dpi. The "duty" herein is a value calculated by the following formula.

$$\text{Duty}(\%)=\text{recorded actual number of dots}/(\text{vertical resolution}\times\text{horizontal resolution})\times 100$$

(In the formula, the "recorded actual number of dots" is the actual number of dots recorded per unit area, and the "vertical resolution" and the "horizontal resolution" are resolution per unit area respectively)

The evaluation criteria were as follows, and the evaluated results are shown in the following Table 7.

A: Dot omission or flight curves did not occur even after 15 minutes, or occurred within 15 minutes but recovery was possible by a cleaning operation.

C: Dot omission or flight curves occurred within 15 minutes and recovery was not possible even with the cleaning operation.

TABLE 7

| | Discharge stability |
|---|---|
| Ink 1 | A |
| Ink 2 | A |
| Ink 3 | A |
| Adhesive liquid 1 | A |
| Adhesive liquid 2 | A |
| Adhesive liquid 3 | A |
| Adhesive liquid 4 | A |

From the results in Table 7, it was confirmed that all of the prepared inks B1 to B3 and adhesive liquids B1 to B4 were excellent in discharge stability.

Preparation of Transfer Medium

By using a transfer medium producing apparatus which includes the same configuration as shown in FIG. 1 and an evaporation device for evaporating components excluding the solid content in the ink, the transfer medium was prepared. Specifically, first, on a roll-like biaxially extended PET film having a width of 600 mm and a thickness of 12 μm, wax was coated into a film thickness of 20 nm, thereby preparing a releasing layer. In addition, a thermoplastic melamine resin was coated thereon with a thickness of 10 nm, followed by thermal curing for 5 minutes at 180° C., thereby preparing a protective layer. In this manner, a transfer film base medium was prepared. Next, this transfer film base medium was installed in a predetermined position in the transfer medium producing apparatus, and the mass of droplets of 5 ng to 15 ng was appropriately adjusted by changing a piezo device-driving voltage waveform of the ink jet head. Thereafter, using a software program for recording, letters and image patterns were printed at a resolution of 2,880 dpi×1,440 dpi. As the letters, 5 point and 7 point of em Hiragana (font: MS Mincho) was used.

Printing was performed in the following order. First, the ink shown in Table 8 was discharged from the ink jet head and then attached, thereby forming the colored layer. As the first evaporation, the substrate was heated at 50° C. by a platen heater from the surface of the substrate, and the colored layer was exposed to warm air at 40° C., whereby the liquid component was evaporated from the attached ink. Thereafter, when the component (liquid component) excluding the solid content in the ink reached a desired amount described later, the adhesive liquid shown in Table 8 was discharged as 4 ng of droplets from the ink jet head toward the side of the substrate where the colored layer was formed and attached thereto, thereby forming the adhesive layer. The adhesive layer was formed using the software program for recording in 100% duty (so-called solid printing) at a resolution of 1,440 dpi×1,440 dpi. Subsequently, as the second evaporation, evaporation and drying (in which the adhesive layer was exposed to warm air at 50° C. for 20 seconds) were further performed using a drying device, thereby preparing the transfer medium.

1. First Evaporation Example B1

70% by mass of the component excluding the solid content in the ink B1 was evaporated.

2. First Evaporation Example B2

80% by mass of the component excluding the solid content in the ink B2 was evaporated.

3. First Evaporation Example B3

90% by mass of the component excluding the solid content in the ink B3 was evaporated.

4. First Evaporation Example B4

90% by mass of the component excluding the solid content in the ink B3 was evaporated.

5. First Evaporation Example B5

95% by mass of the component excluding the solid content in the ink B2 was evaporated.

6. First Evaporation Example B6

90% by mass of the component excluding the solid content in the ink B3 was evaporated.

Evaluation of Printing Resolution

The evaluation criteria were as follows, and the evaluated results are shown in the following Table 8.

A: Letters of 5 points or less could be read clearly.

C: Letters of 5 points or less could not be read.

Transfer Property Evaluation

The transfer medium slit-processed into 100 mm width was installed in a predetermined position of a hot stamping machine (R415F-TP, roll-on type, manufactured by AMAGASAKI MACHINERY Co., Ltd), and the transfer medium was transferred to an acrylic resin plate as a medium to be transferred at a heat compression roller temperature of 150° C., pressure of 30 Kg/cm$^2$, and speed of 20 cm/second.

The evaluation criteria were as follows, and the evaluated results are shown in the following Table 8.

A: Letters of 5 points or less could be completely transferred.

C: Letters of 5 points or less could not be completely transferred.

Adhesiveness Evaluation

Based on JIS D0202-1988, a cross cut tape peeling test was performed on the colored layer on the acrylic resin plate to which the transfer medium had been transferred in the above transfer property evaluation. Sellotape (registered trade mark) (CT24, manufactured by Nichiban Co., Ltd) was adhered to the colored layer by being pressed by a finger and then peeled off. Adhesiveness was evaluated by being represented by the number of cells where the colored layer was not peeled among 100 cells. That is, if the colored layer was not peeled at all, it was represented as "100/100", and if the colored layer was completely peeled, it was represented as "0/100". The evaluation criteria were as follows, and the evaluated results are shown in the following Table 8.

S: 0/100

AAA: More than 0/100 and less than 10/100

AA: 10/100 or more and less than 20/100

A: 20/100 or more and less than 30/100

C: 30/100 or more

TABLE 8

| | Ink | | Adhesive liquid | | | | | |
|---|---|---|---|---|---|---|---|---|
| | Number | Resin content | Number | Resin content | Evaporated amount of ink (with respect to component excluding solid content | Printing resolution | Transfer property | Adhesiveness |
| First evaporation example 1 | 1 | 1.5 | 1 | 8 | 70% by mass | A | A | AA |
| First evaporation example 2 | 2 | 2.0 | 2 | 2.5 | 80% by mass | A | A | AA |
| First evaporation example 3 | 3 | 2.0 | 3 | 25.0 | 90% by mass | A | A | AA |
| First evaporation example 4 | 3 | 2.0 | 2 | 2.5 | 90% by mass | A | A | A |
| First evaporation example 5 | 2 | 2.0 | 2 | 2.5 | 95% by mass | A | C | AA |
| First evaporation example 6 | 3 | 2.0 | 4 | 3.0 | 90% by mass | A | A | AA |

From the results in Table 8, it was clearly shown that by using the ink and adhesive liquid having excellent discharge stability, and by causing the content ratio of the resin in the ink which had been discharged and attached to the substrate to be smaller than the content ratio of the resin in the adhesive liquid which had been discharged and attached after the ink, as shown in first evaporation examples B1 to B4, printing could be performed with a higher resolution (the pattern of the colored layer in the transfer medium could be formed with a higher resolution) compared to the first evaporation example B4 in which the relationship of the content ratio of resin was opposite to the above relationship, and the transfer property was better. Moreover, the adhesiveness between the medium to be transferred or the colored layer and the adhesive layer became excellent after transfer.

What is claimed is:

1. A method of producing a transfer medium comprising:

attaching an ink which contains a resin and is discharged from an ink jet head onto a substrate;

evaporating 65% to 95% by mass of a liquid component included in the ink having been attached to the substrate; and attaching an adhesive liquid which contains a resin and is discharged from the ink jet head to a substrate surface where the ink in which 65% to 95% by mass of the liquid component has been evaporated is attached, wherein a content ratio of the resin in the ink is smaller than that of the resin in the adhesive liquid.

2. The method of producing a transfer medium according to claim 1, wherein the ink is an aqueous pigment ink, the aqueous pigment ink includes a water-soluble organic solvent having a boiling point of 70° C. to 250° C., and the water-soluble organic solvent is an aqueous liquid including one or more components selected from lactams, carboxylic acid esters, alkylene glycol ethers, and alcohols.

3. The method of producing a transfer medium according to claim 1, wherein the adhesive liquid includes a water-soluble organic solvent having a boiling point of 70° C. to 250° C., and the water-soluble organic solvent is an aqueous liquid including one or more components selected from lactams, carboxylic acid esters, alkylene glycol ethers, and alcohols.

4. The method of producing a transfer medium according to claim 1, wherein the adhesive liquid is an aqueous liquid including an emulsion type thermoplastic resin.

5. The method of producing a transfer medium according to claim 1, wherein the substrate is a metal, plastic, or paper.

6. A transfer medium obtained by the producing method according to claim 1.

7. A set of ink and adhesive liquid used for the method of producing a transfer medium according to claim 1.

* * * * *